US007628194B2

(12) United States Patent
Wagner et al.

(10) Patent No.: US 7,628,194 B2
(45) Date of Patent: Dec. 8, 2009

(54) DUAL ANGLED CANOPY RETRACTABLE AWNING

(75) Inventors: Robert Wagner, Longmont, CO (US); Jeffrey B. Rutherford, Longmont, CO (US); Scott P. Thompson, Boulder, CO (US); Erwin J. Gaudyn, Broomfield, CO (US); Todd Hoffman, Boulder, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 170 days.

(21) Appl. No.: 11/781,752

(22) Filed: Jul. 23, 2007

(65) Prior Publication Data

US 2008/0029225 A1 Feb. 7, 2008

Related U.S. Application Data

(60) Provisional application No. 60/821,677, filed on Aug. 7, 2006.

(51) Int. Cl.
*E04F 10/06* (2006.01)

(52) U.S. Cl. ..... 160/22; 160/66; 160/79

(58) Field of Classification Search ..... 160/22, 160/66, 67, 70, 79; 135/88.11, 88.12; 296/163
See application file for complete search history.

(56) References Cited

U.S. PATENT DOCUMENTS 1,905,339 A * 4/1933 Brown ..... 160/22
3,736,976 A * 6/1973 Palmer ..... 160/70
4,615,371 A * 10/1986 Clauss ..... 160/22
4,733,683 A * 3/1988 Pozzi ..... 160/22
5,232,036 A * 8/1993 Brutsaert ..... 160/70
6,056,350 A * 5/2000 Brutsaert ..... 296/163
6,363,664 B1 * 4/2002 Brutsaert ..... 52/74
6,457,508 B1 * 10/2002 Tomita ..... 160/67
6,598,612 B1 * 7/2003 Crowe ..... 135/88.12
6,782,936 B1 * 8/2004 Girard et al. ..... 160/66
7,017,976 B1 * 3/2006 Rutherford et al. ..... 296/163
7,152,652 B2 * 12/2006 Heitel ..... 160/5
7,188,889 B2 * 3/2007 Wagner et al. ..... 296/163
2006/0151125 A1 * 7/2006 Llagostera Forns ..... 160/79
2007/0051476 A1 * 3/2007 Forns ..... 160/79

* cited by examiner

*Primary Examiner*—David Purol
(74) *Attorney, Agent, or Firm*—Dorsey & Whitney LLP

(57) ABSTRACT

A retractable awning includes a roller reversibly driven and mounted within a housing for support on a support structure and both inner and outer sets of pivotally interconnected support arms for supporting an awning canopy when extended. The inner set of support arms support the canopy beneath an inner segment of the canopy adjacent the support surface and are designed to deploy before the outer set of support arms with the outer set of support arms supporting the canopy beneath an outer segment of the canopy further away from the support surface than the inner segment. Both the inner and outer sets of support arms can be partially or fully deployed to regulate the extent to which the awning is extendible away from the support surface. The outer support arms are mounted for pivotal movement within a plane forming a different angle with horizontal than the inner set of support arms so the inner segment of the canopy above the inner set of support arms when extended forms a different angle with horizontal than does the outer segment of the awning canopy overlying the outer set of support arms when extended.

10 Claims, 12 Drawing Sheets

DUAL ANGLED CANOPY RETRACTABLE AWNING

CROSS REFERENCE TO RELATED APPLICATION

This application claims priority to U.S. provisional application 60/821,677 filed Aug. 7, 2006 and is hereby incorporated by reference as if fully disclosed herein.

BACKGROUND OF THE INVENTION

1. Field of the Invention

The present invention relates generally to a retractable awning for mounting on a support surface with the awning having a reversibly driven roller anchoring an inner edge of an awning canopy and inner and outer pairs of pivotal support arms that extend and retract with extension and retraction of the awning whereby the awning canopy forms two different angles relative to horizontal when fully extended.

2. Description of the Relevant Art

Retractable awnings have been in use for many years on building structures as well as mobile homes, recreational vehicles, and the like. The awnings are adapted to extend away from the side of the structure or vehicle to form shade adjacent the side thereof or be retracted adjacent to the support surface. When extended, the awning canopy forms a substantially planar sheet that is typically inclined relative to horizontal so that rain water will run off the canopy and shelter the area beneath the canopy not only from rain but from sun.

In the case of recreational vehicles and mobile homes, some such vehicles have recently been provided with slide-out units which are box-like structures which can be extended out of the vehicle to increase the usable space within the vehicle or retracted into the vehicle, for example when the vehicle is being moved or driven. When extended, the slide-out unit has a side wall displaced from the side of the vehicle in parallel relationship therewith as well as a top wall, bottom wall, and opposite side walls connecting the outer wall with the vehicle. A problem with slide-out units has resided in the accumulation of debris on the top wall of the slide-out unit when it is extended with such debris taking the form of dirt, leaves, or the like. When the slide-out unit is retracted back into the vehicle, this debris is also transported into the vehicle on top of the top wall. Accordingly, systems have been devised for covering the top of a slide-out unit to prevent the accumulation of debris so as to avoid the transport of that debris into the vehicle. An example of a cover or canopy for a slide-out unit is shown in U.S. Pat. No. 7,017,976, which is of common ownership with the present invention.

Further, awnings have been provided for recreational vehicles, mobile homes, and the like, having slide-out units wherein the canopy for covering the top of the slide-out unit has its inner edge secured to the vertical side of the vehicle above the slide-out unit and its outer edge secured to a lead bar on pivotal arms mounted on the outer face of the slide-out unit. When the slide-out unit is extended, the canopy covers the top of the slide-out unit and the canopy can then be further extended at a downwardly inclined angle with the pivot arms to serve as an awning over a window in the outer wall of the slide-out unit. An example of such an awning is shown in U.S. Pat. No. 5,860,440, which is also of common ownership with the present application. Such awnings are typically limited to the width of the slide-out unit as their purpose is only to provide a cover for the top of the slide-out unit and an awning for a window that may be provided in the outer wall of the slide-out unit.

In as much as some users of mobile homes and recreational vehicles having slide-out units also desire shade and shelter adjacent the vehicle where individuals can recreate under the protection of an awning, there has been a need for an awning that provides such shade for recreation as well as a cover for a slide-out unit and an awning for a window in the outer wall of the slide-out unit. Prior to the present invention, the cover for the slide-out unit and the awning for any window in the outer wall thereof has required a separate system from the awning conventionally found on recreational vehicles for shading an area adjacent the side of the vehicle.

Accordingly, it is to provide a system for not only covering the top of a slide-out unit and providing an awning for a window in an outer wall thereof, but to also shade and protect an area adjacent the vehicle for recreation that the present invention has been developed.

SUMMARY OF THE INVENTION

The present invention is directed to an awning that can be mounted on a support surface with the awning including an awning roller rotatably anchored to the support surface on which the inner edge of an awning canopy is secured. Inner and outer sets of pivotal support arms are provided with the outer edge of the canopy secured to the outer edge of the outer set of support arms in a manner such that deployment of the awning disposes the awning canopy in two distinct angles relative to horizontal.

The roller for the awning is reversibly driven so that when driven in a direction to extend the awning, the support arms, which are biased outwardly, encourage the awning canopy to extend away from the support surface. The inner sets of support arms are mounted at a first angle relative to horizontal for pivotal movement within a plane forming that angle and the outer sets of support arms are pivotally connected to the outer ends of the inner support arms so as to pivot in a second plane forming a second angle relative to horizontal. Accordingly, when the awning is extended, an inner segment of the awning canopy adjacent to the support surface forms a first angle relative to horizontal and an outer segment of the awning canopy outwardly from the first segment forms a second angle.

When the awning is mounted adjacent to the top of a motor home, recreational vehicle, or the like, having a slide-out unit, the inner segment of the awning canopy will cover not only an area adjacent the side of the vehicle but also the top of the slide out unit when it is extended. The outer segment of the awning canopy defines an awning for windows along the side of the vehicle and the outer wall of the slide-out unit when the outer segment is at least partially extended and when it is fully extended, the outer segment of the awning canopy also provides shade and shelter from rain or the like over a relatively large area adjacent the side of the mobile home, recreational vehicle, or the like.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

The retractable awning 20 of the present invention, while possibly finding use on permanent building structures, finds a particular use on mobile homes or recreational vehicles 22 having slide-out units 24 in the form of box-like structures which can be extended from the side of the vehicle and retracted back into the vehicle. Further, while the awning could be mounted on a vertical side wall or support structure, for purposes of the present disclosure, the awning has been described as being mounted on the roof of a recreational vehicle adjacent to a side of the vehicle having a slide-out unit disposed therein.

Figure 1:
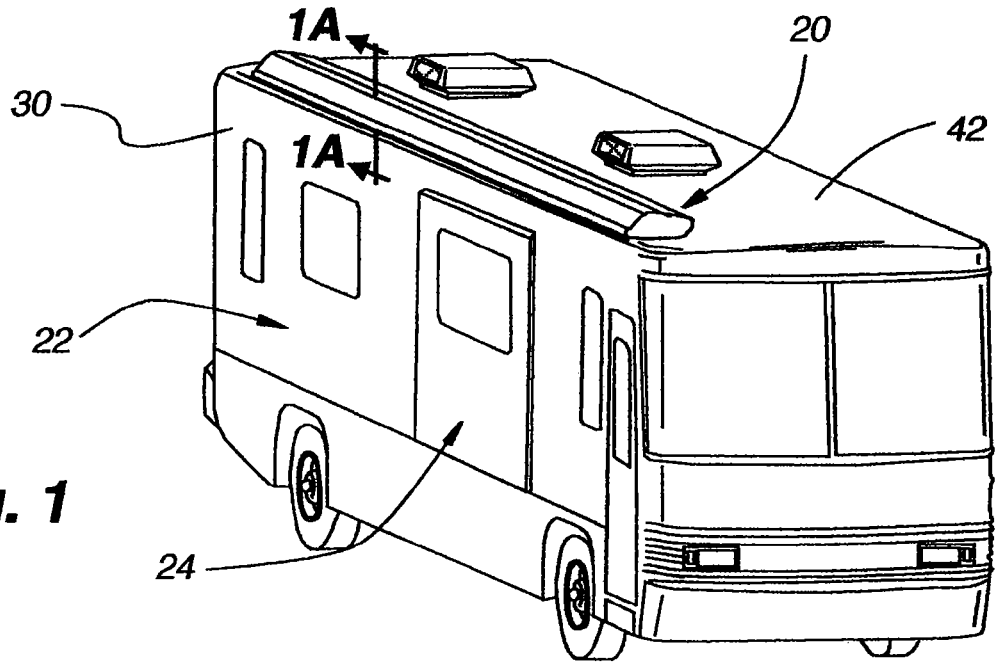
FIG. 1 is an isometric of a recreational vehicle having the retractable awning of the present invention mounted on the roof thereof and in a fully retracted position with the vehicle having a retracted slide-out unit.
Figure 2:
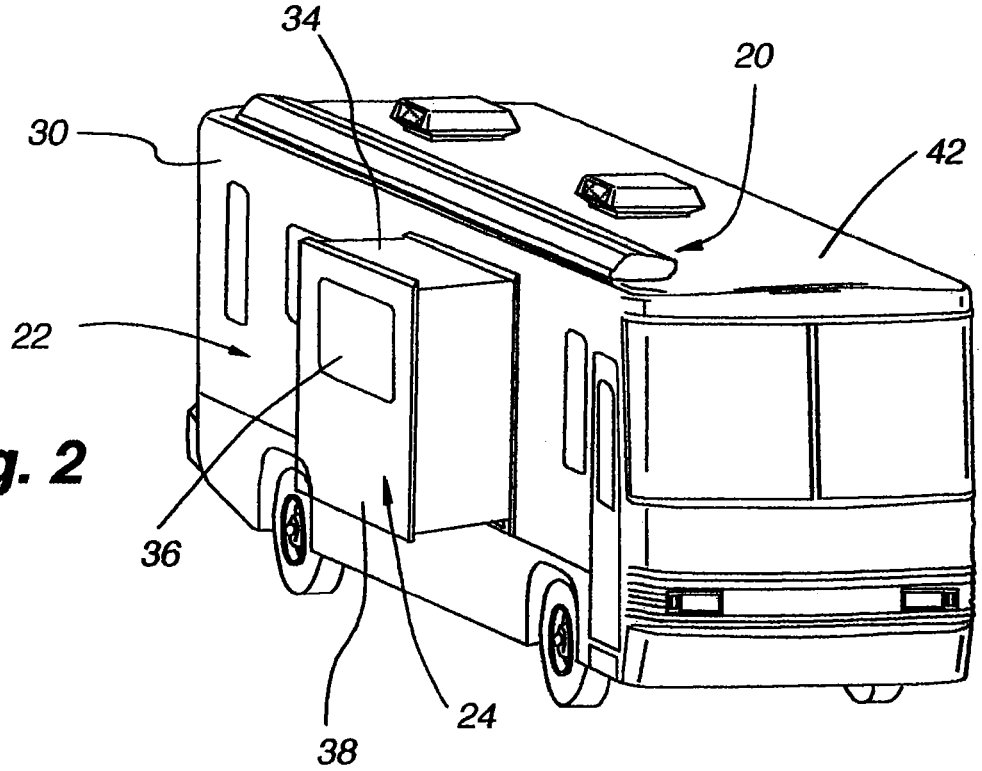
FIG. 2 is an isometric similar to FIG. 1 with the slide-out unit extended from the side of the vehicle.
Figure 3:
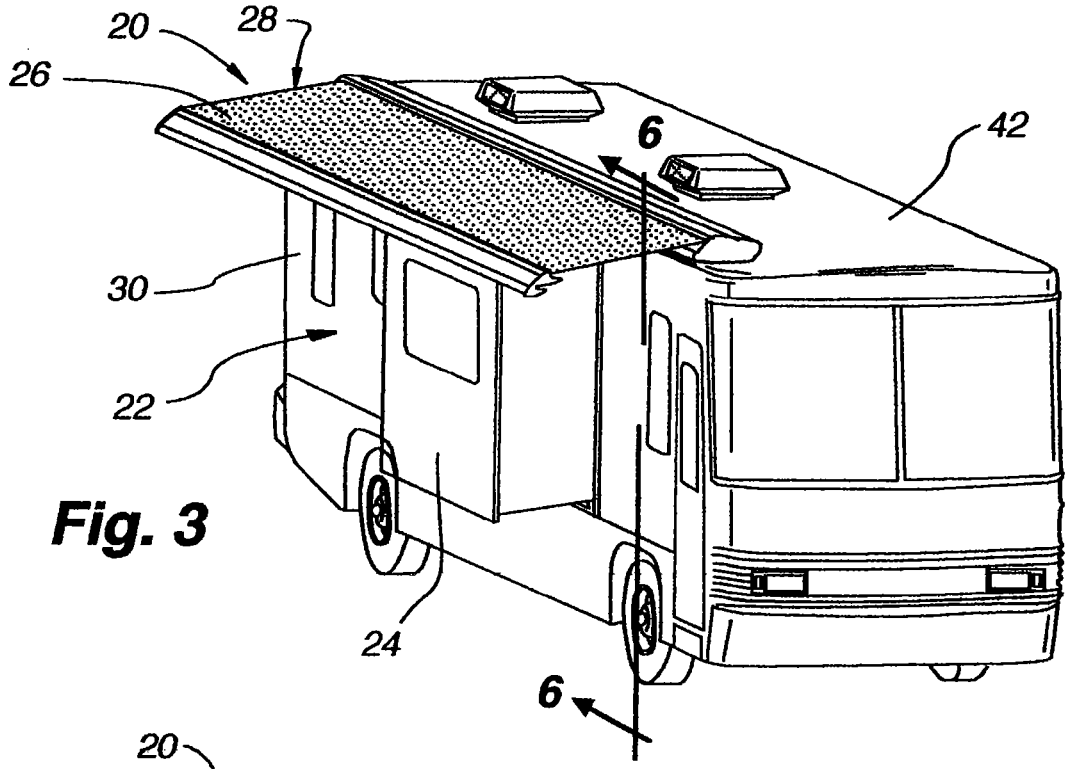
FIG. 3 is an isometric similar to FIG. 2 with the awning extended to a first position overlying the slide-out unit and with the canopy in a substantially planar condition.
Figure 4:
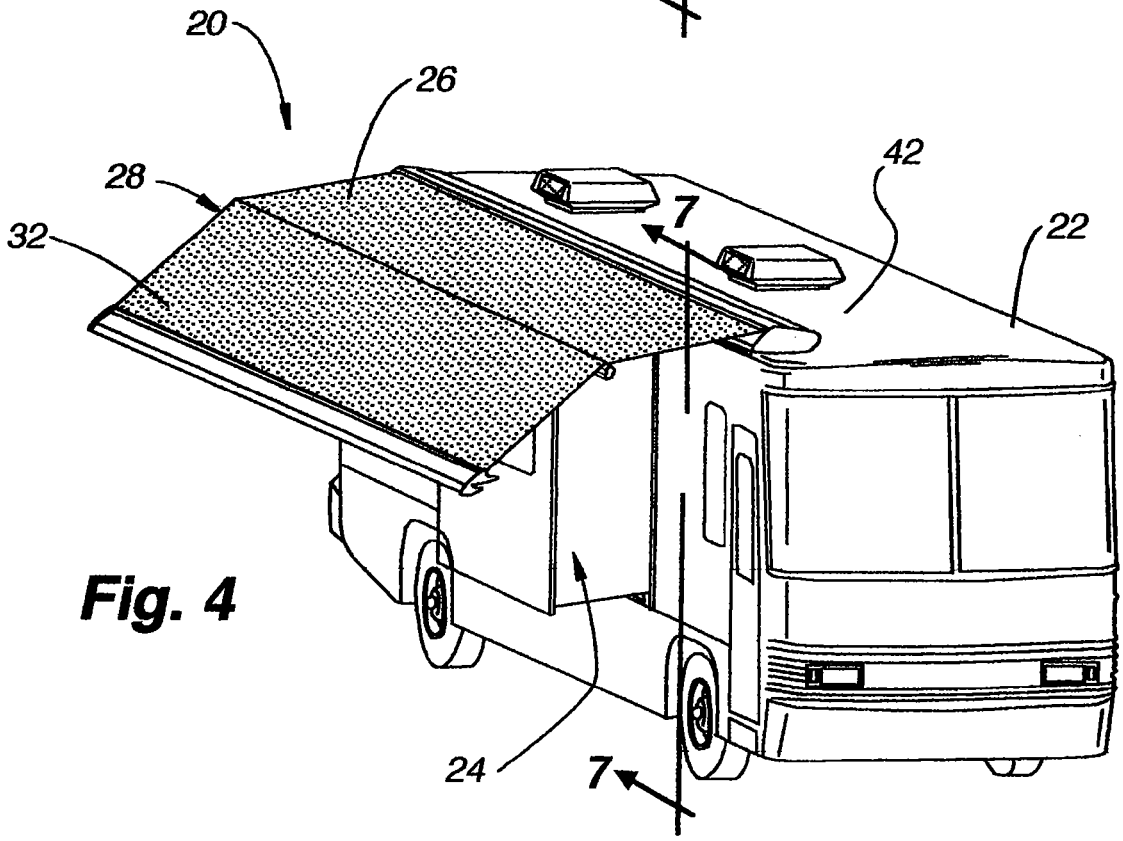
FIG. 4 is an isometric similar to FIG. 3 with the awning further extended so an outer segment of the awning canopy forming an angle relative to the inner segment forms shade for a window in the outer wall of the slide-out unit.
Figure 5:
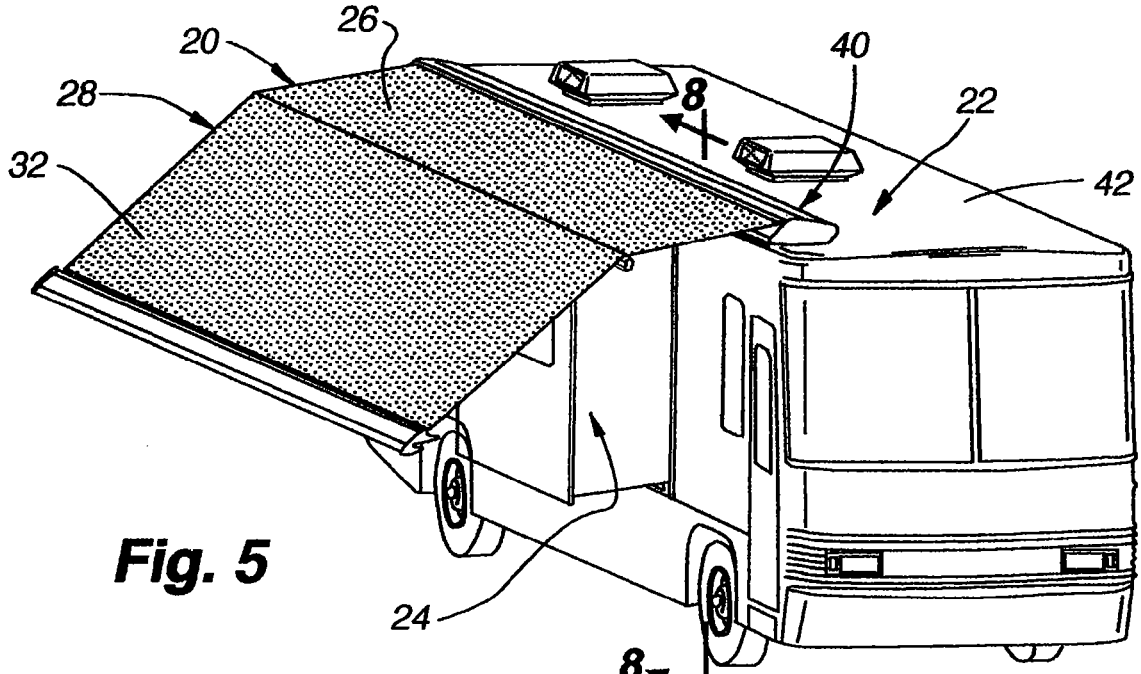
FIG. 5 is an isometric similar to FIG. 4 with the awning canopy further extended so the second segment of the canopy covers a larger area than as shown in FIG. 4.

While the awning 20 is movable between a retracted position (FIGS. 1 and 2) and an indefinite number of extended positions, the extended positions might be divided into three desired positions shown for example in FIGS. 3, 4 and 5. In FIG. 3, the awning is shown in a first abbreviated extended position wherein an inner segment 26 of the canopy 28 of the awning forms a generally planar cover adjacent the side 30 of the vehicle and over the slide-out unit 24, FIG. 4 shows the awning in a further extended or intermediate extended position wherein the awning canopy is extended beyond that shown in FIG. 3 with the canopy forming inner 26 and outer 32 segments having different angles relative to horizontal so it not only covers the top 34 of the slide-out unit but also forms an awning for a window 36 provided in an outer wall 38 of the slide-out unit, and a fully extended position of FIG. 5. In the fully extended position of FIG. 5, the awning canopy has the same two inner and outer segments shown in FIG. 4 but the outermost segment 32 is of a larger size so the canopy not only forms an awning for the window 36 in the slide-out unit but also shades and protects a large area adjacent to the side of the vehicle.

Figure 6:
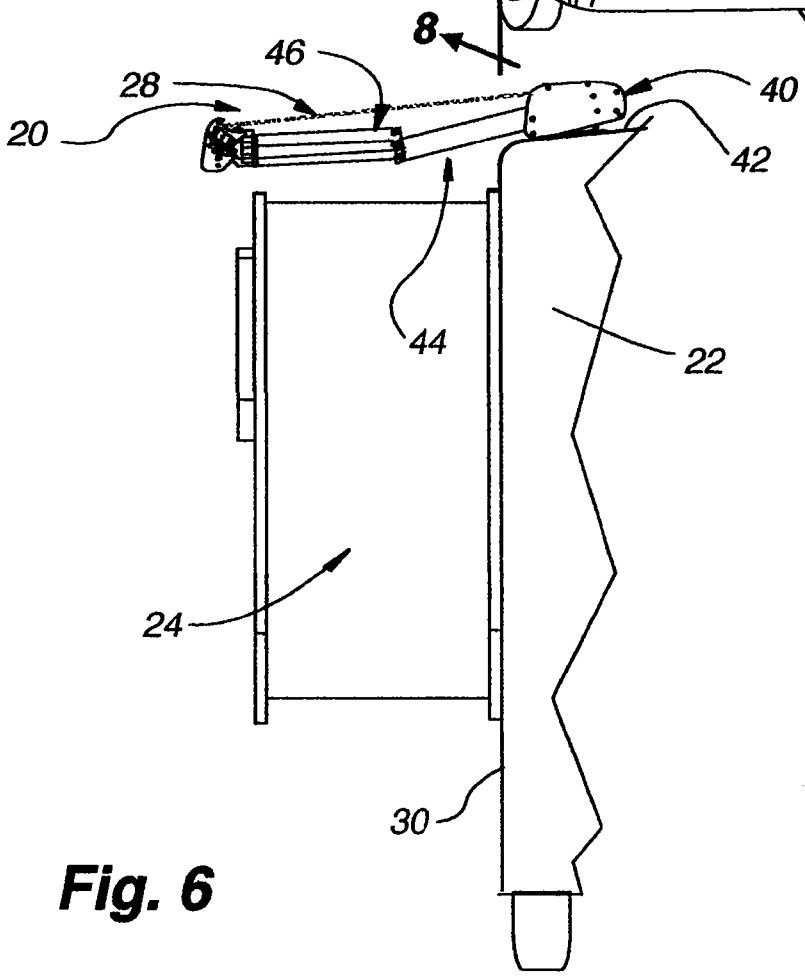
FIG. 6 is an enlarged fragmentary section taken along line 6-6 of FIG. 3.
Figure 7:
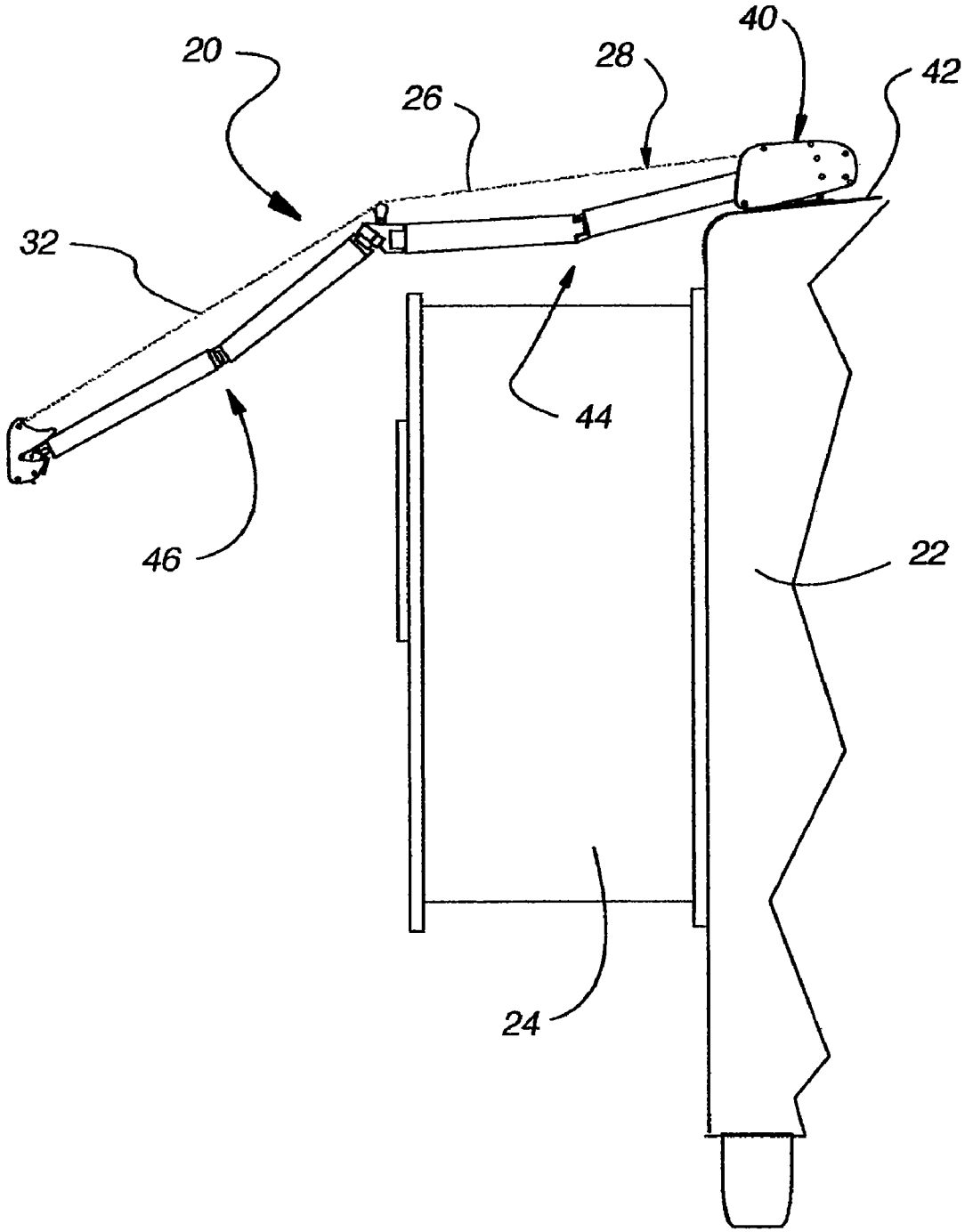
FIG. 7 is an enlarged fragmentary section taken along line 7-7 of FIG. 4.
Figure 8:
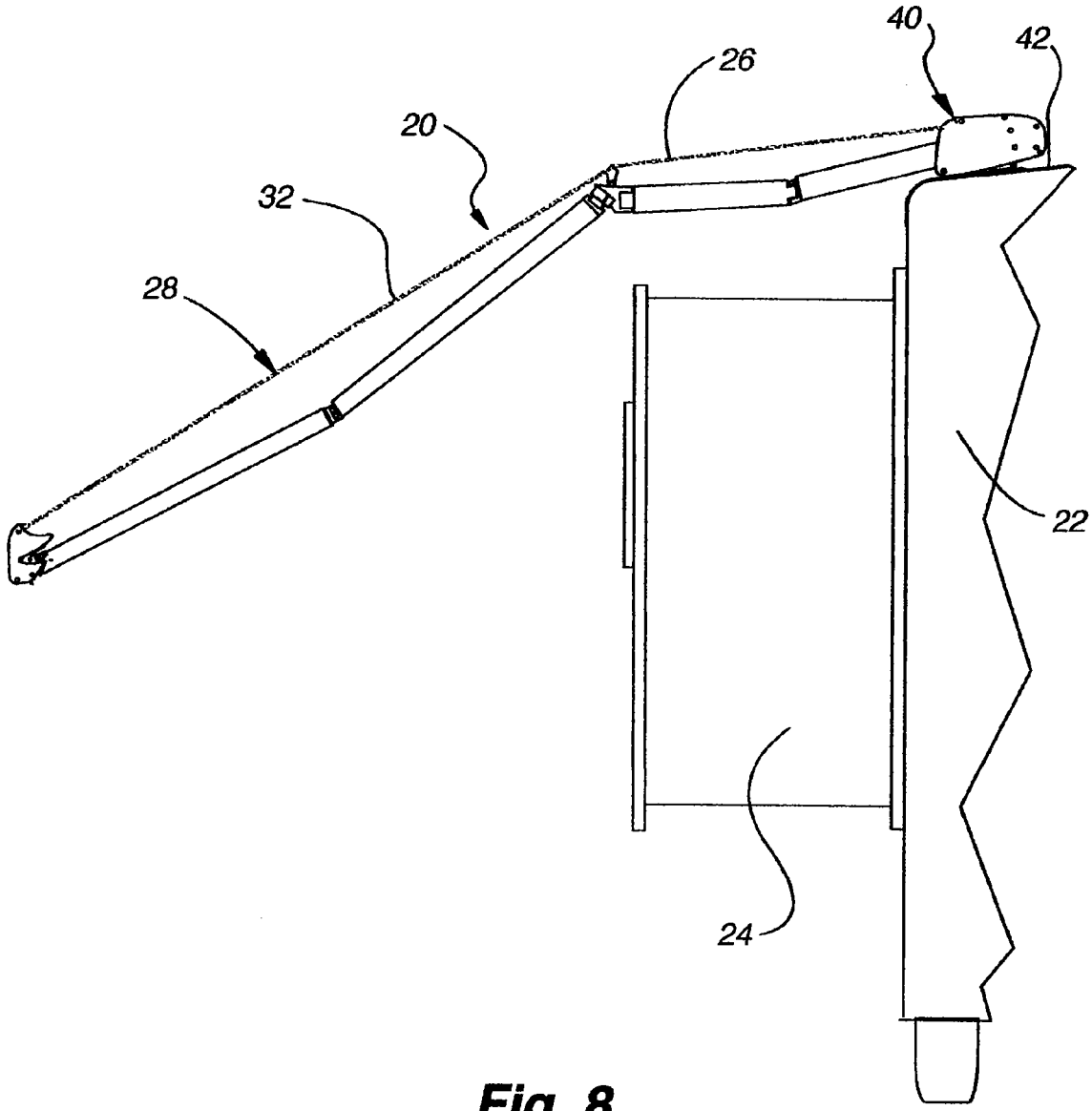
FIG. 8 is an enlarged fragmentary section taken along line 8-8 of FIG. 5.
Figure 9:
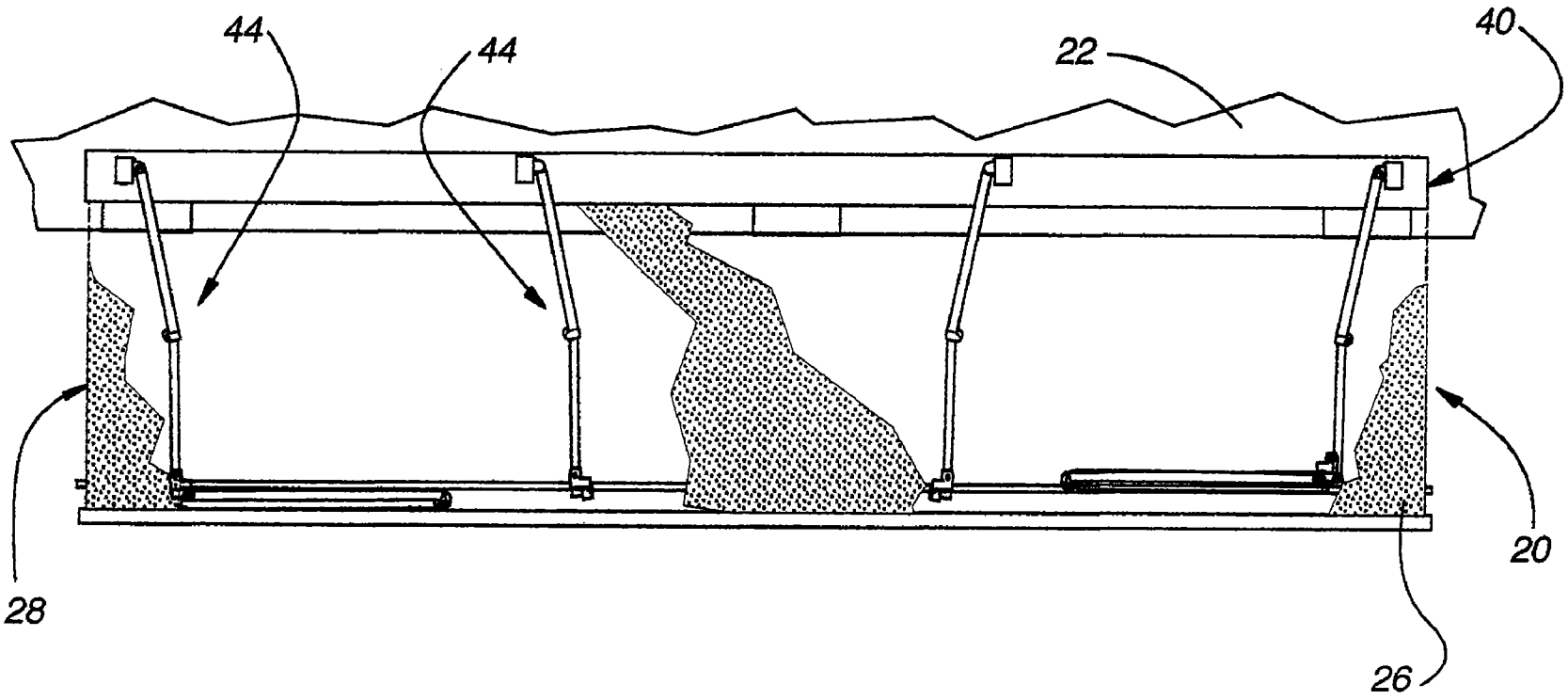
FIG. 9 is a fragmentary top plan view showing the awning disposed as in FIG. 3.
Figure 10:
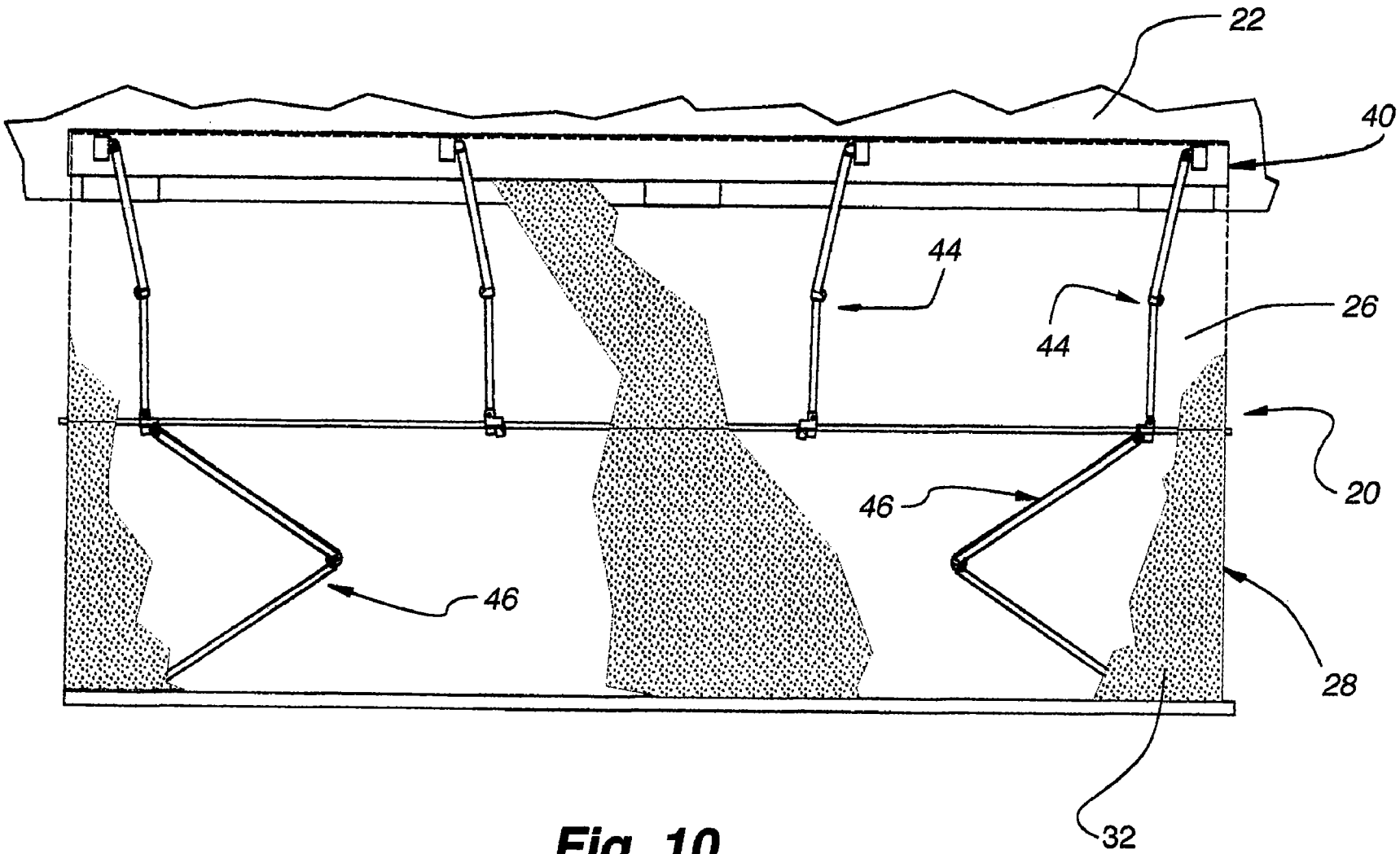
FIG. 10 is a fragmentary top plan view showing the awning disposed as in FIG. 4.
Figure 11:
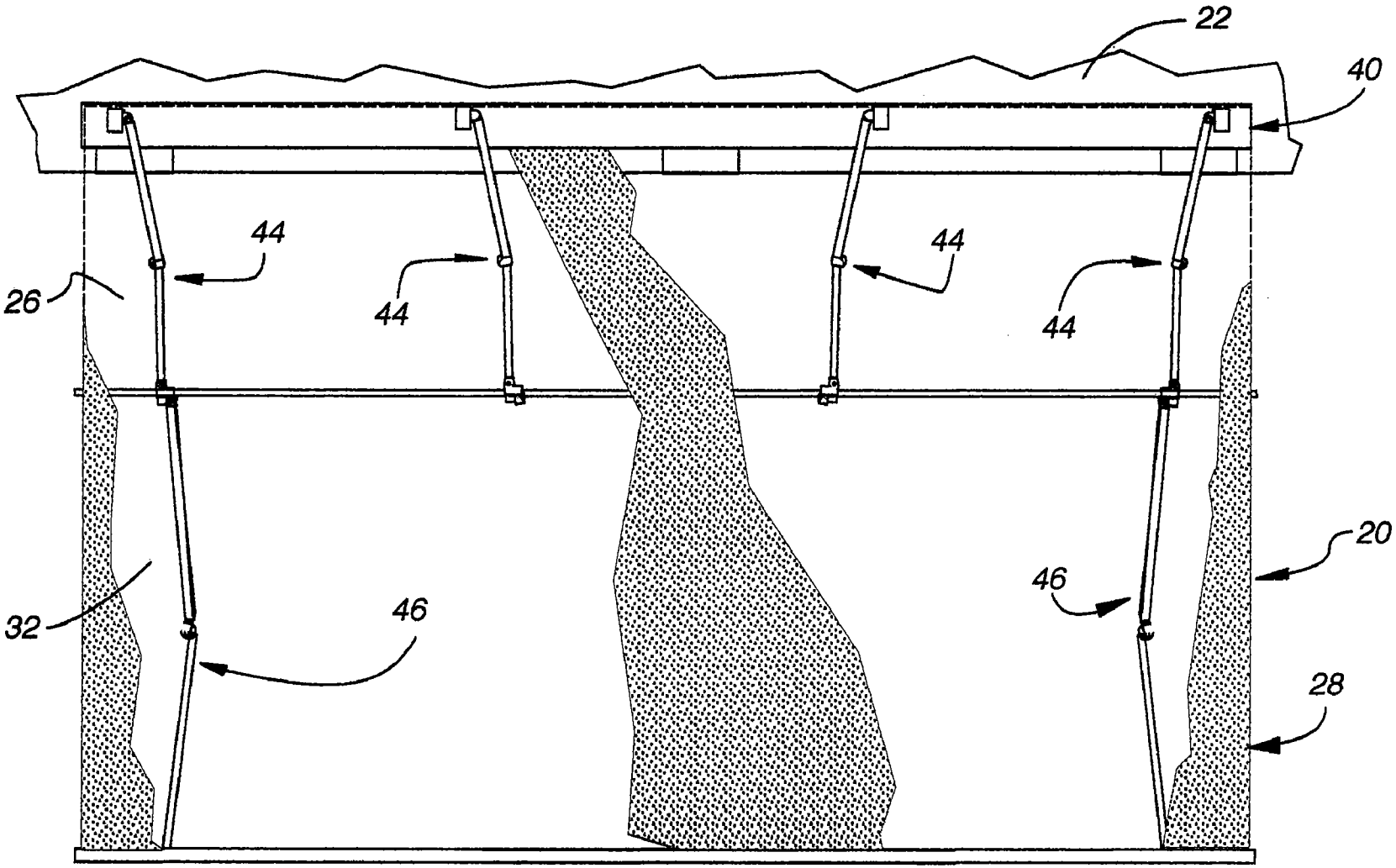
FIG. 11 is a fragmentary top plan view showing the awning as disposed in FIG. 5.

With general reference to FIGS. 6-11, which are side elevations and top plan views of the awning 20 in the three extended conditions illustrated respectively in FIGS. 3, 4, and 5, it can be appreciated the awning includes a base structure 40 anchored to the top 42 of the recreational vehicle with extendible inner sets 44 of pivotal support arms and extendible outer sets 46 of pivotal support arms. The awning canopy 28 extends from the base structure on the vehicle, to which its inner edge is secured, to the outer ends of the outer sets of support arms to which its outer edge is operatively secured. As will be appreciated from the description of the awning hereafter, when the awning is extended from its fully retracted position of FIG. 2, the inner sets 44 of support arms initially extend or deploy while the outer sets 46 remain in a retracted or folded condition so the awning canopy forms the inner segment 26 in a generally planar extension from the vehicle. The inner segment extends out to a point where it covers the top 34 of the slide-out unit 24 and further extension of the awning causes the outer sets of support arms to deploy with the outer sets of support arms being mounted at an angle relative to the inner sets of support arms so the outer segment 32 of the canopy over the outer sets of support arms forms a different angle relative to horizontal than does the inner segment of the canopy over the inner sets of support arms. Further, the outer sets of support arms can be partially extended to the position illustrated in FIGS. 4, 7, and 10 so the outer segment of the canopy overlying the outer sets of support arms is of substantially the same size as the inner segment of the canopy overlying the inner sets of support arms even though it forms a different angle with horizontal. Further extension of the outer sets of support arms, however, to the fully extended position of the awning as shown in FIGS. 8 and 11, illustrate the outer segment of the awning canopy being much larger than the inner segment while still forming an angle relative thereto.

The base structure 40 for the awning is probably best illustrated with reference to FIGS. 1A, 12 and 13. It will be seen to include an extruded mounting base 48 of a rigid material such as aluminum or the like that is securable with fasteners (not shown) in any suitable manner to the top 42 of the recreational vehicle. The mounting base in turn supports an extruded auxiliary plate 50 having extruded ribs and channels defined in more detail hereafter. Support brackets 52 are mounted on the auxiliary plate. The mounting base and support brackets cooperate in supporting a three-piece covering or housing 54 with each piece of the covering or housing also being extruded and having complementary grooves and projections for interconnection and for covering the roller 56 for the awning 20 about which the awning canopy 28 is wrapped when retracted or partially extended. End plates 58 are provided at each end of the awning for supporting opposite ends of the various components of the base structure for its structural integrity with one end plate shown in FIG. 12, supporting a reversible motor 60 having a gear reduction unit 62 insertable into the open end of the roller 56 for reversibly driving the roller during extension or retraction of the awning. A gear reduction component 64 in the gear reduction unit has a groove 66 formed therein that cooperates with an inwardly directed rib 68 formed in the extruded roller so the roller rotates with the reduction unit upon driven motion by the motor in either direction.

The support brackets 52, of which there are any predetermined number depending upon the length of the awning 20 and the number of support arms desired, are mounted at predetermined locations along the length of the auxiliary plate 50. Each support bracket (as best seen in FIG. 13) pivotally supports the inner end 70 of an inner arm 72 of an inner set 44 of support arms with the outer end 74 of the inner arm 72 being pivotally connected with an elbow joint 76 to the inner end 78 of the outer arm 80 of the inner set 44 of support arms. The outer end 82 of the outer arm 80 of the inner set of support arms is pivotally connected to a pivot bracket 84 which may or may not support an outer set 46 of support arms but where it does support an outer set of support arms, the arms in the outer set are identical to the arms in the inner set except they are longer. Where an outer set 46 of support arms are utilized, the inner end 86 of the inner arm 88 of the outer set of support arms is pivotally connected to the pivot bracket 84 and the outer end 90 of the inner arm 88 is pivotally connected through an elbow joint 92 to the inner end 94 of the outer arm 96 of the outer set of support arms. The outer end 98 of the outer arm 96 of the outer set of support arms is pivotally connected to a yoke bracket 100 that is anchored to a lead bar 102 for the awning that provides closure to the housing 54 when the awning is fully retracted as best seen in FIG. 1A. Where an outer set 46 of support arms is not desired or necessary, the pivot bracket 84 is still provided but there are no outer set of support arms pivotally connected thereto.

Further, as will be described in more detail hereafter, both the inner set 44 of support arms and the outer set 46 of support arms are biased toward an extended or deployed position so when the motor 60 for the awning is driven in an extending direction, the support arms expand or deploy under their own bias. When the motor is driven in a reverse or retracting direction, it overcomes the bias in the support arms allowing them to collapse or fold into the retracted position shown for example in FIG. 13.

With reference again to FIGS. 1A, 12 and 13, the mounting base 48 can be seen to include a forward upwardly extending hook-shaped rib 104 and an intermediate upwardly extending hook-shaped rib 106 which both open rearwardly. Adjacent an inner edge of the mounting base is a forwardly opening upwardly extending rib 108 having a channel formed therein. The forward 104 and intermediate 106 hook-shaped ribs complement and define an anchoring or connecting location for the auxiliary plate 50 which includes forward 110 and intermediate 112 downwardly extending hook-shaped ribs which are confined beneath the upstanding hook-shaped ribs of the mounting base to hold the auxiliary plate against the mounting base. The auxiliary plate has a downturned lip 114 at its forward edge that cooperates with the lead bar 102 in establishing closure when the awning is fully retracted as shown in FIG. 1A.

Figure 1A:
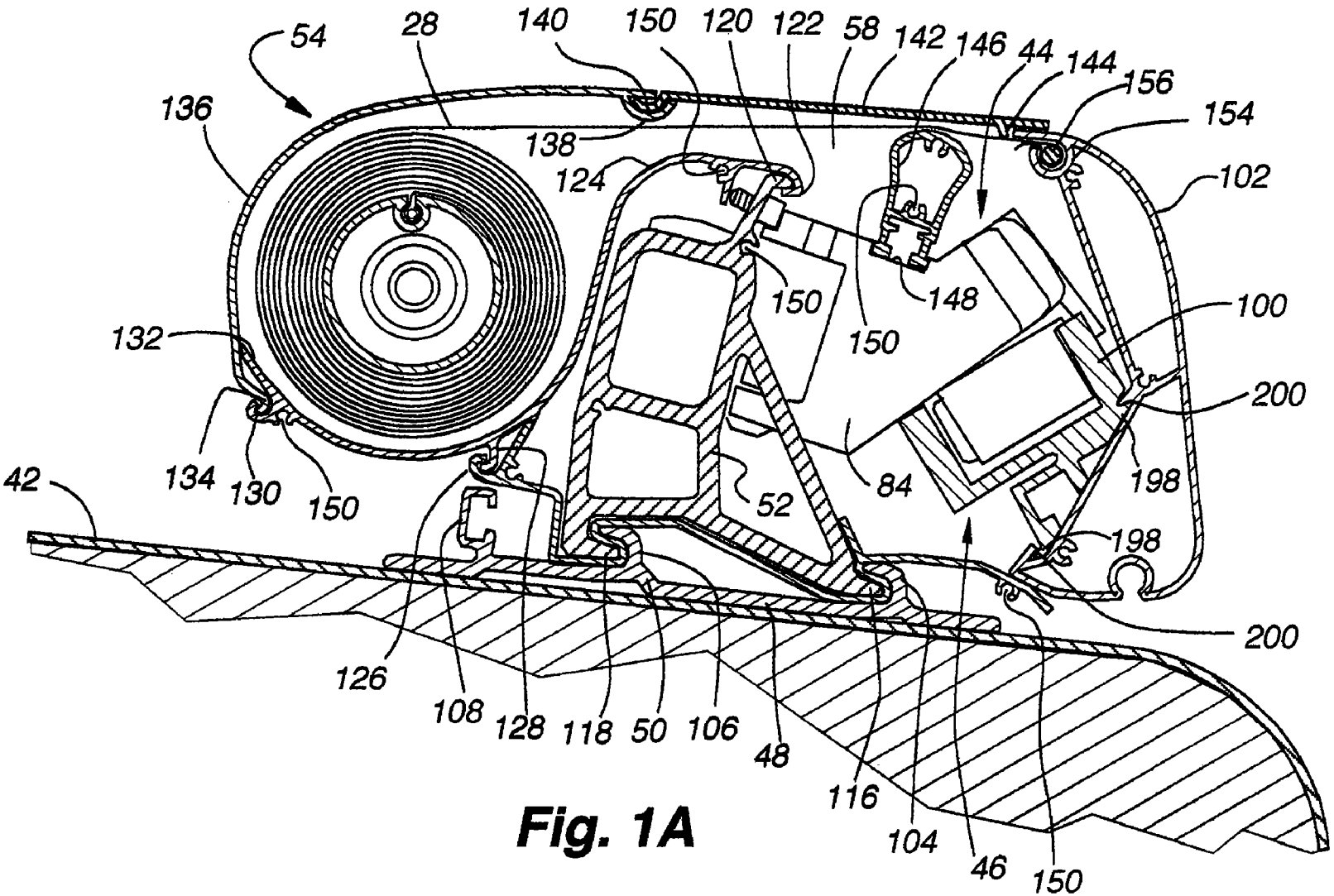
FIG. 1A is an enlarged section taken along line 1A-1A of FIG. 1.

As best seen in FIG. 1A, the support brackets 52 each have a front lower forward protruding edge 116 and a rear lower forwardly protruding edge 118 which are received within the hook-shaped downwardly extending ribs 110 and 112 of the auxiliary plate 50 so the support brackets are also secured to the mounting plate and thereby anchored to the top wall 42 of the mobile home.

The support brackets 52 have an upwardly extending hook-shaped lip 120 that receives a hook-shaped channel 122 on a first housing component 124 while the auxiliary plate 50 has a rear hook-shaped channel 126 for receiving a hook-shaped rib 128 on the first housing component so that the first housing component is anchored along with the support brackets and the auxiliary plate to the mounting base 48. The first housing component is concave upwardly to define a trough in which the roller 56 and canopy material 28 is confined. The first housing component has a groove 130 and ledge 132 along its rearmost edge that cooperate with a rib 134 on a lower edge of a second housing component 136 to interconnect the second housing component with the first housing component. The opposite or upper end of the second housing component has a groove 138 formed therein which cooperates with a curved rear lip 140 of a third housing component 142 to interconnect the third housing component with the second housing component. The third housing component extends generally horizontally and forwardly and defines a downwardly opening groove 144 at its forward edge in which the top edge of the lead bar 102 is received when the awning is fully retracted as shown in FIG. 1A. An awning support rail 146, as seen in FIG. 1A, but removed from FIGS. 12 and 13 for clarity purposes, is anchored in a groove 148 provided in the top surface of the pivot brackets 84 so the support rail 146 can extend along the full length of the awning and support the canopy within the housing.

As noted in FIG. 1A with reference numeral 150, the auxiliary plate 50, support rail 146, support brackets 52, and first housing component 124 are each provided with extrusions defining C-shaped channels that open at opposite ends of the various components and into which fasteners (not shown) can be inserted for connecting the end plates 58 to the various components of the base structure 40. As appreciated by reference to FIG. 12, the end plates have holes 152 therethrough aligned with the channels 150 for securing the end plates to the designated components.

Figure 12:
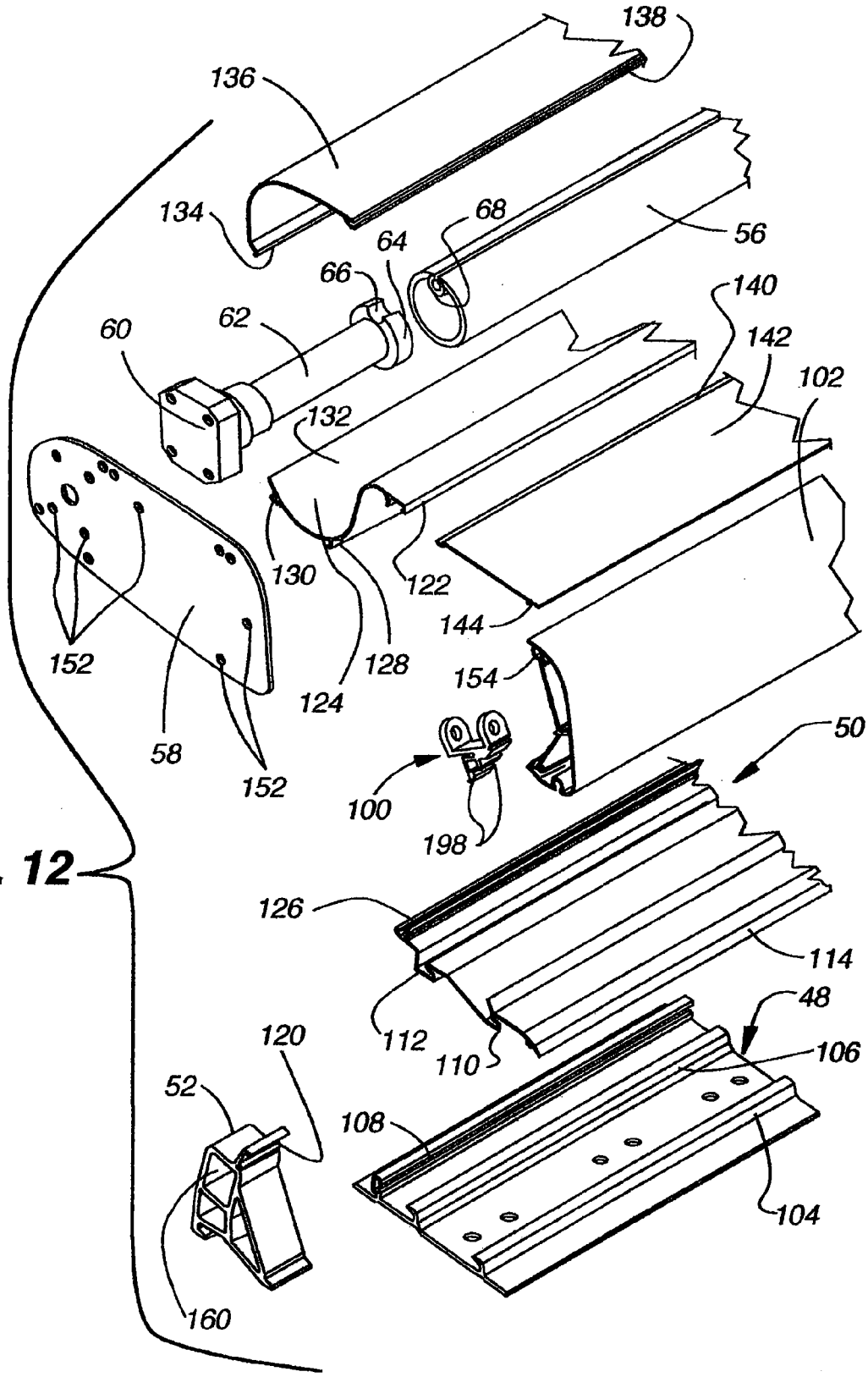
FIG. 12 is an exploded fragmentary isometric showing components of the awning and its mounting base structure without illustrating the support arms.

The lead bar 102, as possibly best seen in FIG. 1A and FIG. 12, has a C-shaped channel 154 at its upper end in which the outer edge of the awning canopy 28 is secured by hemming a loop in the outer edge of the awning canopy, extending the loop into the channel and inserting a retention bar 156 through the hem within the groove.

Figure 13:
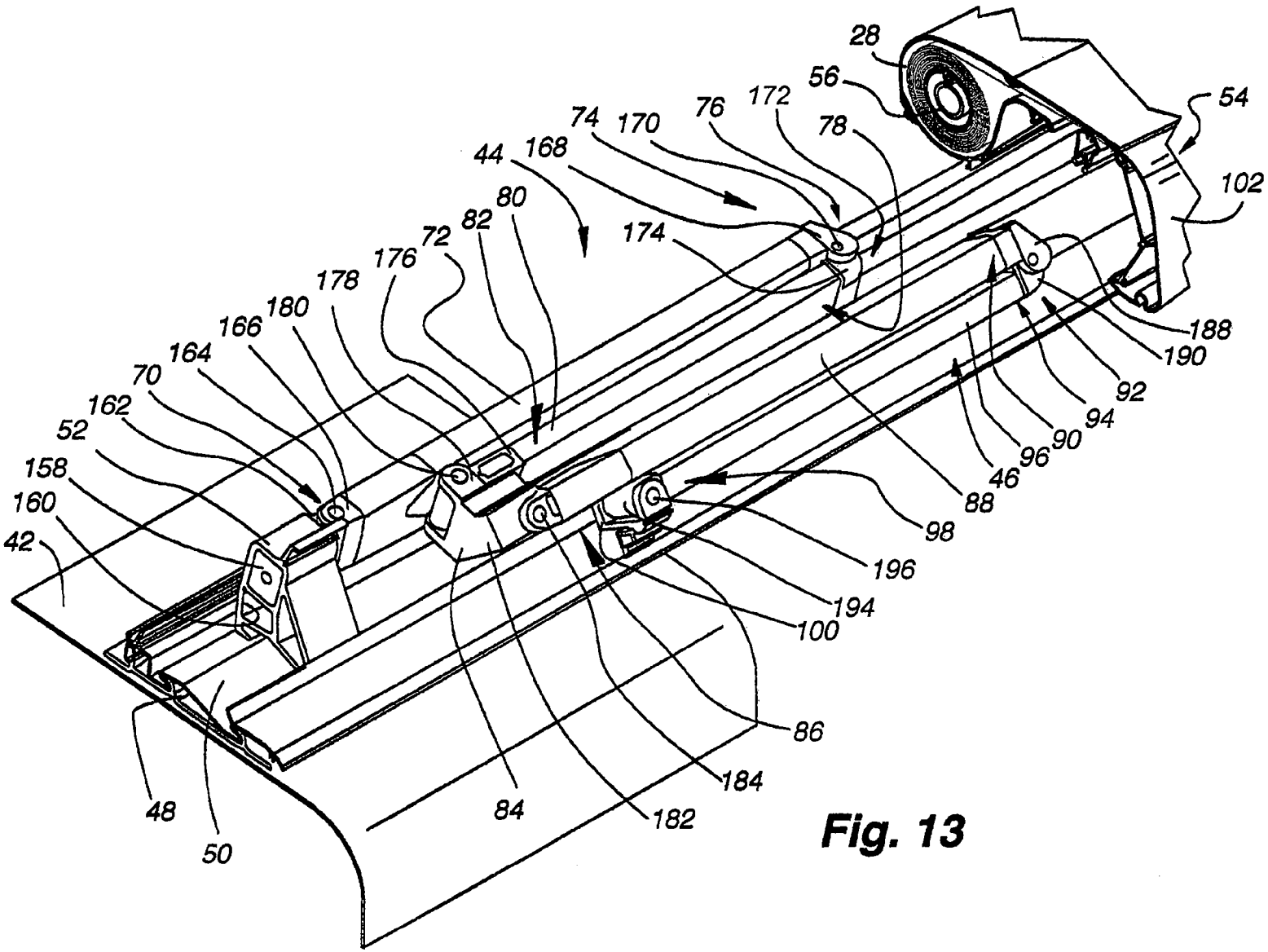
FIG. 13 is an isometric showing the awning and its base structure mounted on the top of a recreational vehicle with the awning in a fully retracted position and with parts removed for clarity.
Figure 14:
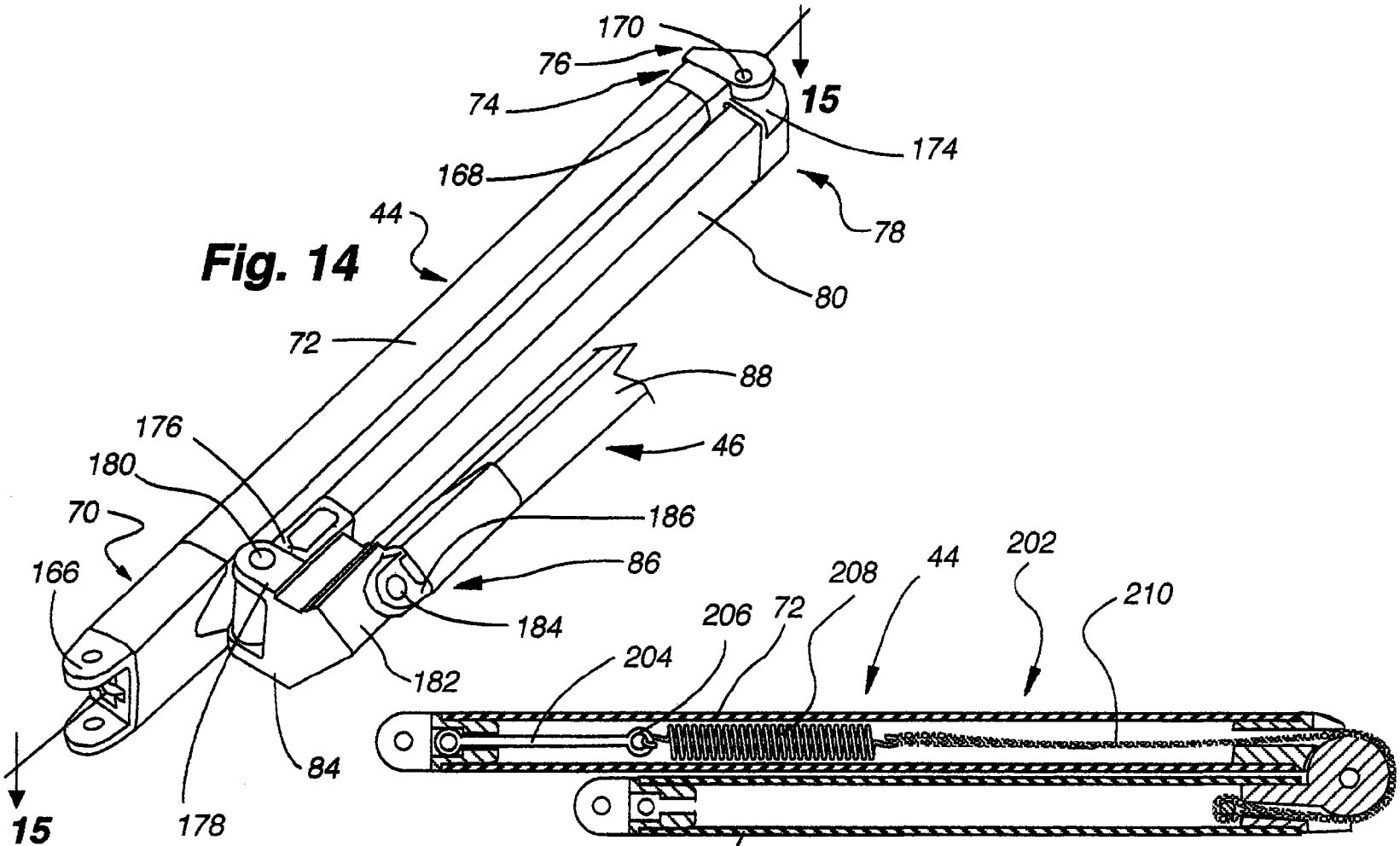
FIG. 14 is an isometric of the inner set of support arms for the awning and a portion of the outer set in a fully retracted position.
Figure 15:
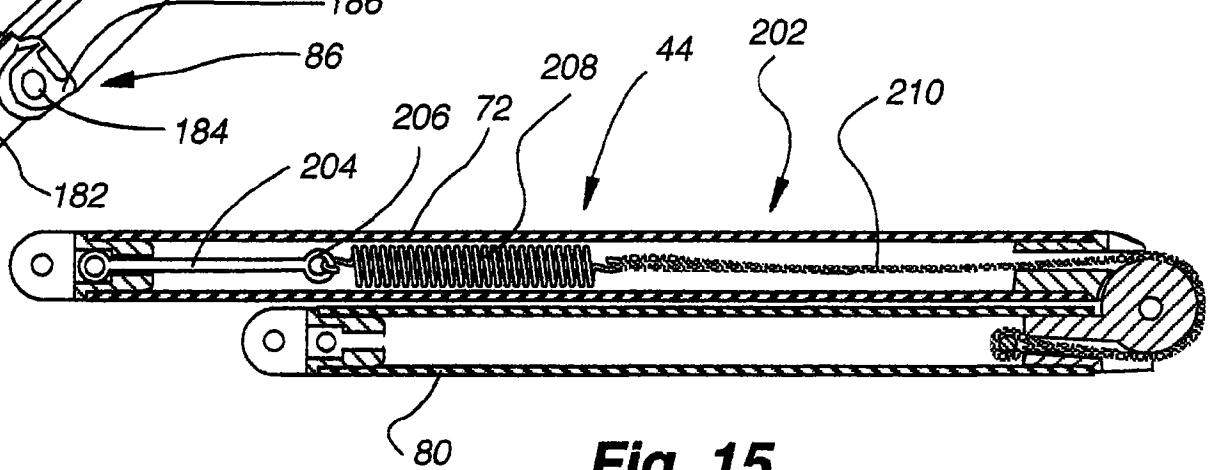
FIG. 15 is a section taken along line 15-15 of FIG. 14.

With reference to FIGS. 13-15, the inner end 70 of each inner arm 72 of the inner set 44 of support arms is pivotally connected to a support bracket 52 with a plug 158 received in a passage 160 in the support bracket with the plug having a longitudinal extension 162 and with the extension having a passage therethrough for receipt of a pivot pin 164 extending through the arms of a yoke 166 on the inner end of the inner arm of the inner set of support arms. The yoke can be an insertable plug into the open inner end of the inner support arm 72. It will be appreciated the pivot pin 164 is positioned at an acute angle to vertical so that pivotal movement of the inner arm of the inner set of support arms is within a plane forming an acute angle with horizontal as best seen in FIGS. 6, 7, and 8. The outer end 74 of the inner arm 72 of an inner set 44 of support arms also has a plug 168 with a yoke for receiving a pivot pin 170 that extends in parallel relationship with the first pivot pin 164 with this yoke being pivotally connected at an elbow 172 to a plug 174 in the inner end 78 of the outer arm 80 of an inner set 44 of support arms so the inner and outer arms of the inner set of support arms pivot about the pivot pin 170. The opposite or outer end 82 of the outer support arm 80 of the inner set of support arms has a plug 176 with a passage therethrough that cooperates with a yoke 178 on the pivot bracket 84 again with a pivot pin 180 extending parallel to the first-identified pivot pins 164 and 170 so the pivot bracket pivots relative to the outer arm 80 of the inner set of support arms in the same plane as the inner set of support arms.

The pivot bracket 84, however, has an arm 182 forming an angle relative to the yoke 178 with a passage through the arm for receiving a pivot pin 184 that cooperates with a yoke 186 in the inner end 86 of the inner arm 88 of an outer set 46 of support arms with this pivot pin forming a different angle with vertical than the first three identified pivot pins whereby the inner arm 86 of the outer set of support arms will pivot at a different and more downwardly inclined angle from horizontal than the first set of support arms. While the plane of movement of the inner arm of the outer set of support arms moves within a plane that still forms an acute angle with horizontal, it is a greater angle than that of the plane in which the inner set of support arms pivot.

The outer end 90 of the inner support arm 88 of an outer set 46 of support arms has a yoke 188 at the end thereof identical to the yoke in the plug 168 at the outer end of the inner arm of the inner set of support arms with that yoke cooperating with a plug 190 in the inner end 94 of the outer arm 96 of the outer set of support arms at the elbow 92 for pivotal movement similar to the elbow 172 in the inner set of support arms. The outer end 98 of the outer arm 96 of the outer set of support arms has a plug 194 with a passage therethrough for receipt of a pivot pin 196 that cooperates with the yoke bracket 100, which in turn is secured to the lead bar 102 through ribs 198 on the yoke bracket cooperating with channels 200 formed in the rear face of the lead bar as best seen in FIG. 1A.

As will be appreciated from the above, all pivotal movement of the inner sets 44 of support arms is in a plane forming a first angle relative to horizontal while all pivotal movement of the outer support arms is in a plane forming a different and greater acute angle relative to horizontal. Accordingly, it will be appreciated that, as the awning is moved from its fully retracted to its fully extended positions, the awning canopy passes in its inner segment 26 through a first angle relative to horizontal above the inner sets 44 of support arms, and the outer segment 32 through a second more acute angle relative to horizontal above the outer sets 46 of support arms.

With reference to FIG. 15, and as mentioned previously, both the inner 44 and outer 46 sets of support arms are spring biased to an expanded or deployed condition and this is achieved with a cable/spring system 202 within the hollow arms of each set. In FIG. 15, an inner set of support arms (the cable/spring system for an outer set being identical) are illustrated showing a spring anchor 204 fixed in the inner end 70 of the inner arm 72 of an inner set with the spring anchor having a loop 206 at one end for connection to a coil spring 208 whose opposite end is secured to a non-elastic cable 210 that extends out of the outer end 74 of the inner support arm of an inner set and around the elbow joint 76 where it is anchored in the plug in the inner end 78 of the outer arm 80 of an inner set of support arms. As will be appreciated, by properly tensioning the coil spring and obtaining the desired strength of spring, the arms will be biased toward a deployed or extended position but can be retracted to the folded position of FIG. 15 by overcoming the spring bias.

As mentioned previously, the inner sets 44 of support arms are designed to deploy before the outer sets 46 of arms. This is accomplished by attending to the strength and/or number of coil springs 208 used in the inner set versus those of the outer set. For purposes of the present disclosure, the strength of the coil springs in both the inner and outer sets are similar but as can be appreciated by reference to FIG. 9, there are four sets of inner support arms and only two sets of outer support arms so in aggregate, there is more strength in the inner set of arms than the outer set of arms so they fully deploy before the outer set of arms begin to deploy. At locations where there are only inner sets of support arms, the pivot bracket 84 is connected only to the outer end of the outer support member of an inner set of support members but no outer support arms are connected to the pivot bracket.

Although the present invention has been described with a certain degree of particularity, it is understood the disclosure has been made by way of example, and changes in detail or structure may be made without departing from the spirit of the invention as defined in the appended claims.

The invention claimed is:

1. A retractable awning for attachment to a support surface comprising in combination:

a base structure;

a system for securing the base structure to the support surface;

a roller rotatably supported on said base structure with a flexible awning canopy sheet secured thereto along an inner edge of the canopy sheet;

at least two inner sets of inner support arms having an inner arm and an outer arm with the inner and outer arms of each inner set being connected together with an inner elbow joint, said inner arm of each inner set being operatively pivotally connected at an inner end thereof to said base structure, and said outer arm of each said inner set having a pivot bracket at its outer end distinct from the pivot bracket of any other inner set, at least two outer sets of outer support arms having an inner arm and an outer arm with the inner and outer arms of each outer set being connected together with an outer elbow joint, said inner arm of each said outer set having an inner end operatively pivotally connected only to an associated pivot bracket at said outer end of said outer arm of an associated inner set, an outer end of said outer arm of each outer set being operatively secured to an outer edge of said canopy sheet, there being a separate pivot bracket for each associated inner and outer sets of supports arms, and a system for extending and retracting said inner and outer sets of support arms to extend and retract said awning.

2. The awning of claim 1 wherein said inner elbow joint has a first pivot axis about which said inner and outer arms of the inner set of support arms pivot and said outer elbow joint has a second pivot axis about which said inner and outer arms of said outer set of support arms pivot, and wherein said first and second pivot axes form different angles with vertical.

3. The awning of claim 2 wherein said inner and outer arms of said inner set of support arms pivot within a first common plane about said first pivot axis and said inner and outer arms of said outer set of support arms pivot in a second common plane about said second pivot axis, such that said first and second common planes form different angles relative to horizontal.

4. The awning of claim 3 wherein each of said pivot brackets have third and fourth pivot axes parallel respectively to said first and second pivotal axes.

5. The awning of claim 4 wherein said outer end of said outer arm of each inner set of support arms is pivotally connected to an associated pivot bracket for movement about said third pivot axis and said inner end of the inner arm of each outer set of arms is pivotally connected to an associated pivot bracket for movement about said fourth pivot axis.

6. The awning of claim 5 further including a support rail operatively connected to said pivot brackets to support said canopy sheet when said awning is extended.

7. The awning of claim 1 further including a reversible motor operably connected to said roller for extending and retracting said awning.

8. The awning of claim 1 wherein said system for extending and retracting said inner and outer sets of support arms is a spring biased system biasing said sets of support arms toward an extended position.

9. The awning of claim 8 wherein said spring biased system includes a coil spring associated with each set of inner and outer support arms.

10. The awning of claim 9 wherein said spring biased system further includes a non-extensible cable associated with each coil spring and wherein said spring and associated cable are disposed internally on a set of support arms.

* * * * *